US009821825B2

(12) United States Patent
Kim et al.

(10) Patent No.: US 9,821,825 B2
(45) Date of Patent: Nov. 21, 2017

(54) APPARATUS AND METHOD FOR PROCESSING ATC INTERMITTENT INFORMATION IN RAILWAY

(71) Applicant: LSIS CO., LTD., Anyang-si, Gyeonggi-do (KR)

(72) Inventors: Seok Heon Kim, Seoul (KR); Jae Mun Han, Incheon-si (KR); Yong Gee Cho, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 667 days.

(21) Appl. No.: 14/264,878

(22) Filed: Apr. 29, 2014

(65) Prior Publication Data

US 2014/0343768 A1 Nov. 20, 2014

(30) Foreign Application Priority Data

May 15, 2013 (KR) ..... 10-2013-0054724

(51) Int. Cl.
*B61L 3/12* (2006.01)

(52) U.S. Cl.
CPC ..... *B61L 3/126* (2013.01); *B61L 3/121* (2013.01)

(58) Field of Classification Search
CPC ..... B61L 3/121; B61L 3/126
See application file for complete search history.

(56) References Cited

U.S. PATENT DOCUMENTS 5,347,305 A * 9/1994 Bush ..... G10L 19/00 348/14.01
6,212,190 B1 * 4/2001 Mulligan ..... H04L 29/06 370/400
6,876,696 B1 * 4/2005 Goodson ..... H04L 5/1438 370/497
6,944,121 B1 * 9/2005 Weste ..... H04B 1/405 370/208
7,212,138 B1 * 5/2007 Bosnyak ..... H03M 1/502 327/158
9,105,112 B2 * 8/2015 Holland ..... G06F 1/3228
2003/0083024 A1 * 5/2003 Richenstein ..... H04H 20/62 455/99
2003/0221082 A1 * 11/2003 Bhardwaj ..... H04J 3/047 711/201
2005/0002405 A1 * 1/2005 Gao ..... G06F 13/102 370/401
2006/0139188 A1 * 6/2006 Sasakura ..... H03M 7/3084 341/51

(Continued)

FOREIGN PATENT DOCUMENTS

CN 101330609 12/2008
CN 102447530 5/2012

*Primary Examiner* — Khaled Kassim
(74) *Attorney, Agent, or Firm* — Lee Hong Degerman Kang & Waimey

(57) ABSTRACT

The present invention relates to an apparatus and method for processing an intermittent information in railway, the method comprising determining that data of a prescribed first length is received in first and second buffers; reading and storing the data of the first length in the first and second buffers; determining that data of a prescribed second length is received in the first and second buffers; reading and storing the data of the second length in the first and second buffers; and generating a final data by combining the data of the first length and the data of the second length.

15 Claims, 3 Drawing Sheets

(56) References Cited

U.S. PATENT DOCUMENTS

| | | | | |
|---|---|---|---|---|
| 2007/0021085 | A1* | 1/2007 | Kroeger | H04B 7/086 455/272 |
| 2007/0047457 | A1* | 3/2007 | Harijono | H04L 49/90 370/250 |
| 2007/0075149 | A1* | 4/2007 | Yanagida | G06Q 20/341 235/492 |
| 2010/0074312 | A1* | 3/2010 | Cioffi | H04M 11/062 375/222 |
| 2010/0191395 | A1* | 7/2010 | Rosenkranz | B61L 3/125 701/19 |
| 2011/0055130 | A1* | 3/2011 | Kim | G06F 17/30985 706/18 |
| 2012/0063237 | A1* | 3/2012 | Ghilardelli | G11C 16/3418 365/185.24 |
| 2012/0310864 | A1* | 12/2012 | Chakraborty | G06K 9/6262 706/12 |
| 2014/0189231 | A1* | 7/2014 | Maydan | G06F 9/30036 711/110 |
| 2015/0371466 | A1* | 12/2015 | Lu | G07C 9/00007 340/5.61 |
| 2016/0036558 | A1* | 2/2016 | Ibrahim | H04K 3/92 455/297 |

* cited by examiner

APPARATUS AND METHOD FOR PROCESSING ATC INTERMITTENT INFORMATION IN RAILWAY

Pursuant to 35 U.S.C. §119 (a), this application claims the benefit of earlier filing date and right of priority to Korean Patent Application No. 10-2013-0054724, filed on May 15, 2013, the contents of which are hereby incorporated by reference in their entirety.

BACKGROUND OF THE INVENTION

Field of the Invention

The teachings in accordance with the exemplary embodiments of this present invention generally relate to apparatus and method for processing ATC intermittent information in railway.

Description of Related Art

In general, automatic train control (ATC) intermittent information is information necessary for train operation such as tunnel, insulation section, trolley wire change section and the like that are intermittently transmitted whenever necessary to an on-board signal device of a train.

FIG. 1 is a schematic view illustrating a loop transmitting ATC intermittent information and FIG. 2 is a schematic view illustrating a message transmitted through left/right loops.

For example, a loop as in FIG. 1 is buried at an entrance of a tunnel where two loops 120, 130 are respectively arranged between lines 100, 110 and information is transmitted to ATC intermittent information receiving antenna of a train. A length of an ATC intermittent information loop installed a high speed train section in Korea is currently 7 meters.

Referring to FIG. 2, a wayside device (not shown) is configured such that messages A-B are divided to odd bits and even bits and each 88-bit message is transmitted to the on-board equipment via the left loop 130 and the right loop 120. The ATC intermittent information receiving antenna installed on a train receives intermittent information from the loops 120. 130 and the intermittent information is converted to a digital data and transmitted to ATC on-board equipment. The ATC on-board equipment analyzes the received digital data and obtains necessary ground intermittent information.

As noted above, the ATC intermittent information is continuously transmitted from the left/right loops 120,130, where the ATC on-board equipment passes the loops 120, 130 to receive messages. At this time, an amount of messages received in response to the speed of a train is changed. That is, when a train passes 7 m-loops 120, 130 at a 400 km/h speed, the ATC on-board equipment can receive approximately 3.4 messages. However, when a train passes 7 m-loops 120, 130 at a 200 km/h speed, the ATC on-board equipment can receive approximately 6.8 messages. That is, an amount of received messages decreases when a train passes at a high speed and an amount of received messages increases when a train passes at a slow speed, whereby there is a need of obtaining intermittent information by accurately analyzing the received messages because the amount of received messages decreases when a train passes at a high speed.

SUMMARY OF THE INVENTION

The present invention has been made to solve the foregoing disadvantages/problems of the prior art and therefore an object of certain embodiments of the present invention is to provide apparatus and method for processing ATC intermittent information in railway configured to efficiently analyze a signal received from a loop that transmits ATC intermittent information at a high speed operation.

In one general aspect of the present invention, there is provided a method for processing intermittent information in railway, the method comprising: determining that data of a prescribed first length is received in first and second buffers; reading and storing the data of the first length in the first and second buffers; determining that data of a prescribed second length is received in the first and second buffers; reading and storing the data of the second length in the first and second buffers; and generating a final data by combining the data of the first length and the data of the second length.

In some exemplary embodiment of the present invention, the method may further comprise waiting for a predetermined time when a data longer than the first length is received by the first or second buffer.

In some exemplary embodiment of the present invention, the method may further comprise clearing the first or second buffer when the data of the first length is not received in the first and second buffers.

In some exemplary embodiment of the present invention, the first length may correspond to a length of a start-notifying data.

In some exemplary embodiment of the present invention, the second length may correspond to a length of a data including information.

In some exemplary embodiment of the present invention, the generating the final data may include aligning the start-notifying data at a forefront and aligning the data including the information after the start-notifying data.

In some exemplary embodiment of the present invention, the method may further comprise transmitting the final data to on-board equipment in a train.

In another general aspect of the present invention, there is provided an apparatus for processing intermittent information in railway, the apparatus comprising: a first buffer configured to store intermittent information from a first loop arranged on the railway; a second buffer configured to store intermittent information from a second loop arranged near to the first loop; and a processor configured to generate a final data by combining the data received from the first and second buffers.

In some exemplary embodiment of the present invention, the first and second buffers may include a ring buffer.

In some exemplary embodiment of the present invention, the processor may be configured to: determine that data of a prescribed first length is received in first and second buffers; read and store the data of the first length in the first and second buffers; determine that data of a prescribed second length is received in the first and second buffers; read and store the data of the second length in the first and second buffers; and generate the final data by combining the data of the first length and the data of the second length.

In some exemplary embodiment of the present invention, the processor may be further configured to wait for a predetermined time when a data longer than the first length is received by the first or second buffer.

In some exemplary embodiment of the present invention, the processor may be further configured to clear the first or second buffer when the data of the first length is not received in the first and second buffers In some exemplary embodiment of the present invention, the first length may correspond to a length of a start-notifying data.

In some exemplary embodiment of the present invention, the second length may correspond to a length of a data including information.

In some exemplary embodiment of the present invention, the processor may be configured to align the start-notifying data at a forefront and align the data including the information after the start-notifying data.

In some exemplary embodiment of the present invention, the apparatus may further comprise a first antenna configured to receive the intermittent information transmitted from the first loop; and a second antenna configured to receive the intermittent information transmitted from the second loop.

In some exemplary embodiment of the present invention, the apparatus may further comprise a transmitter configured to convert the intermittent information received from the first and second antennas to a digital signal, and transmit the digital data to the first and second buffers

Advantageous Effects

The apparatus and method for processing ATC intermittent information in railway according to an exemplary embodiment of the present invention has an advantageous effect in that frame loss can be minimized and the minimized frame loss can be processed accordingly, when a railway vehicle receives left/right messages of ATC intermittent information with a time delay, or receives a data damaged by noise.

DETAILED DESCRIPTION OF THE INVENTION

Various exemplary embodiments will be described more fully hereinafter with reference to the accompanying drawings, in which some exemplary embodiments are shown. The present inventive concept may, however, be embodied in many different forms and should not be construed as limited to the example embodiments set forth herein. Rather, the described aspect is intended to embrace all such alterations, modifications, and variations that fall within the scope and novel idea of the present disclosure.

Hereinafter, exemplary embodiments of the present invention will be described in detail with reference to the accompanying drawings.

Figure 3:
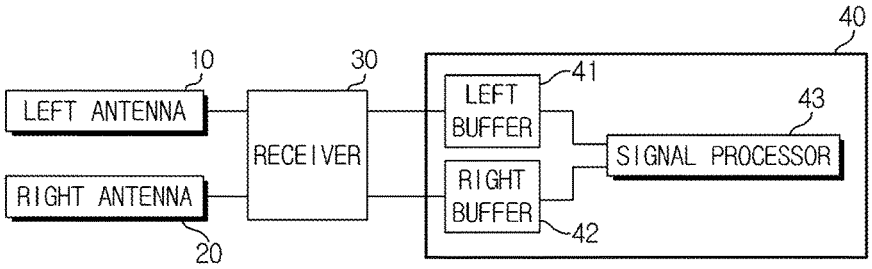
FIG. 3 is a block diagram illustrating on-board equipment for ATC according to an exemplary embodiment of the present invention.

FIG. 3 is a block diagram illustrating on-board equipment for ATC according to an exemplary embodiment of the present invention.

Referring to FIG. 3, the illustrating on-board equipment for ATC according to the present invention may include a left antenna 10, a right antenna 20, a receiver 30 and ATC on-board signal equipment 40, where the ATC on-board signal equipment 40 may include a left buffer 41, a right buffer 42*e* and a signal processor 43.

Figure 1:
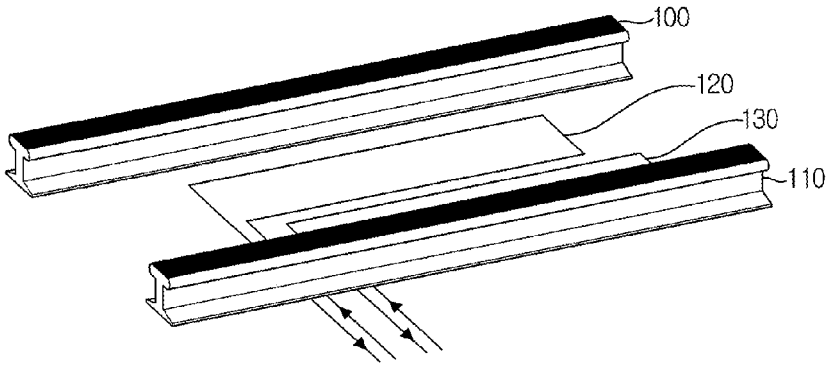
FIG. 1 is a schematic view illustrating a loop transmitting ATC intermittent information.
Figure 2:
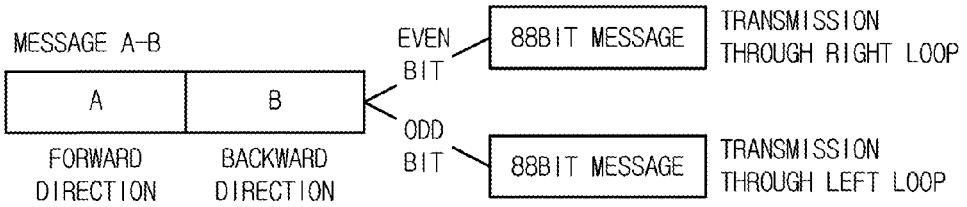
FIG. 2 is a schematic view illustrating a message transmitted through left/right loops.

The left and right antennas 10, 20 are arranged inside a rail of a train, and may respectively receive intermittent information from left/right loops 120, 130 installed on tracks 100, 110 as illustrated in FIG. 1. Although the present invention has illustrated left and right loops 120, 130 for convenience sake, the left and right loops may be loops arranged near to track. The receiver 30 converts a message of analogue type signal received from the left/right antennas 10, 20 to a message of digital data and transmits the digital data to the ATC on-board signal equipment 40.

Communication between the receiver 30 and the ATC on-board signal equipment 40 may be realized using RS232 communication method, but the present invention is not limited thereto and various other communication methods may be used.

The ATC on-board signal equipment 40 may analyze the digital data by combining the messages transmitted from the receiver 30.

Figure 4:
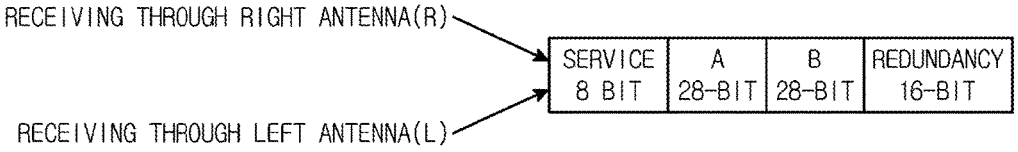
FIG. 4 is a schematic view illustrating a message received by on-board equipment for ATC according to an exemplary embodiment of the present invention.

FIG. 4 is a schematic view illustrating a message received by on-board equipment for ATC according to the present invention.

Referring to FIG. 4, a signal (R) converted to a digital data through the receiver 30 by being received from the right antenna 20 and a signal (L) converted to a digital data through the receiver 30 by being received from the left antenna 30 may include an 8-bit service message, a 28-bit A message (message transmitted through the loop), a 28-bit B message (message transmitted through the loop) and a 16-bit redundancy message.

In general, the ATC on-board equipment 40 analyzes messages by combining the messages received as illustrated in FIG. 4.

A time for transmitting a data from the receiver 30 to the ATC on-board equipment 40 may be calculated in the following way. That is, when a data transmission speed of the receiver 30 is 4800 bps, for example, a data length of one frame is 88-bit, such that transmission of one frame would be 18.304 msec. When a train speed is 400 km/h, it would take 63 msec to pass a 7-m loop, such that a train running at a speed of 400 km/h can receive approximately 3.4 frames. Furthermore, when a train speed is 200 km/h, it would take approximately 126 msec to pass a 7-m loop, such that a train running at a speed of 200 km/h can receive approximately 6.8 frames.

Inasmuch as intermittent information is continuously received according to prior art, and the intermittent information is such that data of ground loops 120, 130 is received through the antennas 10, 20, an intensity of signal may vary according to surrounding environments and circumstances, and a slight time delay may occur because it takes time for the receiver 30 to convert an analogue signal to a digital signal.

Thus, the ATC on-board equipment 40 according to an exemplary embodiment of the present invention may store, in left/right buffers 41, 42, the data received for compensation of time delay of data received through the left/right antennas 10, 20.

Although the left/right buffers 41, 42 may be ring buffers, for example, in the ATC on-board equipment 40 according to an exemplary embodiment of the present invention, the present invention is not limited thereto, and various other types of buffers may be employed.

The data received from the receiver by the ATC on-board equipment 40 may include a data (0Xff) notifying a start of one byte, and data (0x01 to 0x FF) showing actual information of 5 bytes. However, lengths of these data are exemplary and are not limited to the present invention, and may be variably configured as necessary.

The signal processor 43 according to the present invention is configured such that the ATC intermittent information may be received time-delayed through the left/right antennas 10, 20 or received with noise, and in this case, the data processing is performed in consideration of time delay, whereby message analysis can be efficiently performed and messages can be stably analyzed even at a high speed.

The messages analyzed by the signal processor 43 may be transmitted to a unit (not shown) installed for control of on-board equipment, about which no further detailed explanation will be omitted as it has nothing to do with the present invention.

Now, a method for processing ATC intermittent information in railway will be described in detail with reference to the accompanying drawing.

Figure 5:
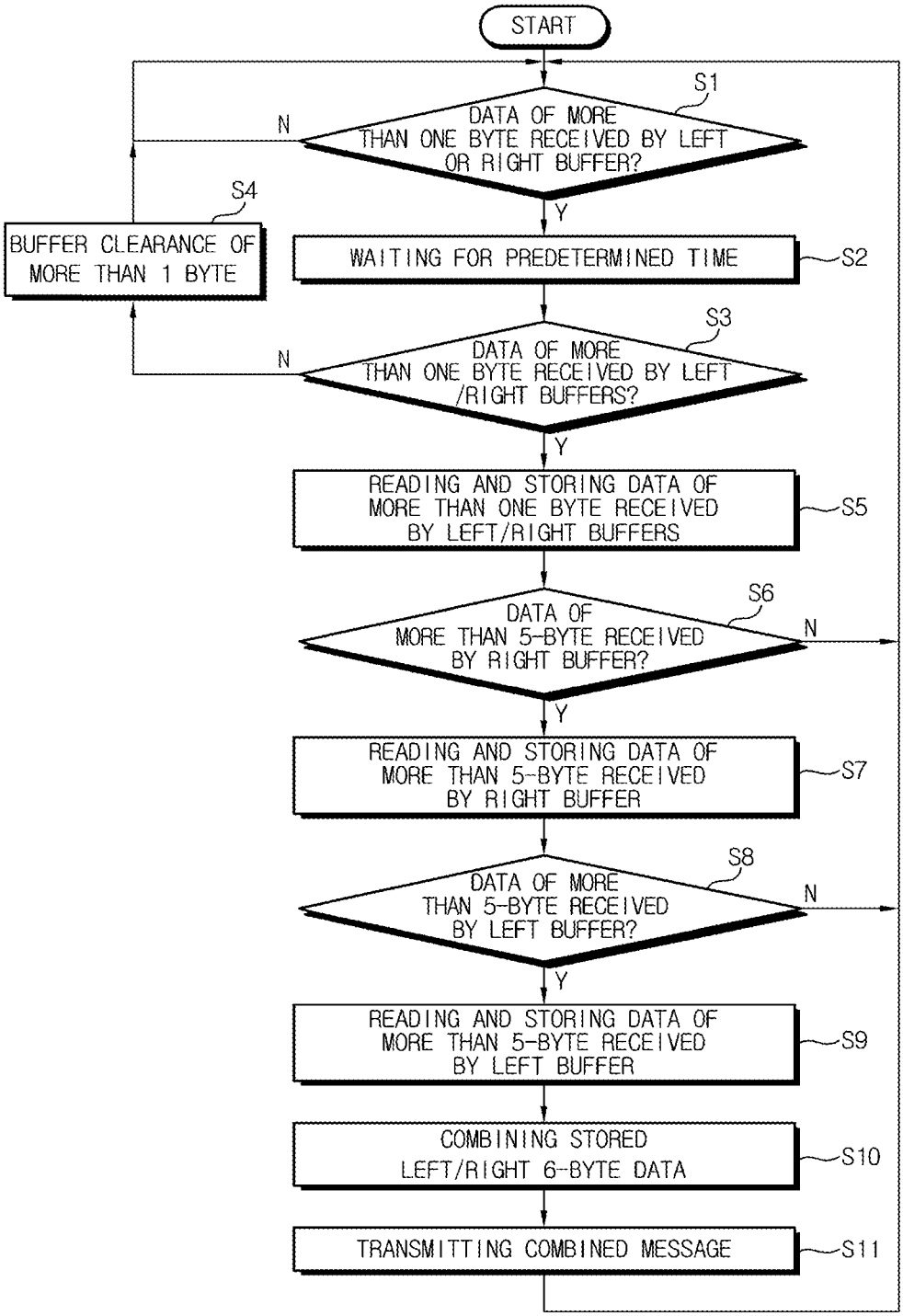
FIG. 5 is a flow chart illustrating a method for processing ATC intermittent information in railway.

FIG. 5 is a flow chart illustrating a method for processing ATC intermittent information in railway, that is, FIG. 5 illustrates a method for processing data received by the signal processor 43 of the ATC on-board signal equipment 40 of FIG. 4.

Referring to FIG. 5, the signal processor 43 according to an exemplary embodiment of the present invention includes checking whether data of more than one byte is received by the left/right buffers 41, 42 (S1), and when it is determined (checked) that one of the left/right buffers 41, 42 receives data of more than one byte, flow waits for a predetermined time (S2). The reason of waiting is to guarantee a time for receiving data of one frame. The predetermined time according to an exemplary embodiment of the present invention may vary according to a train speed or data transmission speed of the receiver 30, and may be 33 msec, for example. However, it should be apparent that the present invention is not limited thereto.

The signal processor 43 may receive data of one frame and checks if data of more than one byte has been received by the left/right buffers 41, 42 after waiting for a predetermined time (S3).

As a result of determination (check) at S3, if data of more than one byte is not received by the left/right buffers 41, 42, the buffers 41, 42 having received data of more than one byte are cleared (S4) and flow returns to S1. As a result of determination (check) at S3, if data of more than one byte is received by the left/right buffers 41, 42, data of one byte received by the left/right buffers 41, 42 may be read and stored (S5).

Successively, the signal processor 43 checks if data of more than five bytes is received by the right buffer 42 (S6), and as a result of determination (check) at S6, if data of more than five bytes is received by the right buffer 42, the data of five bytes received by the right buffer 42 may be read and stored (S7). The signal processor 43 checks if data of more than five bytes is received by the left buffer 41 (S8), and as a result of determination (check) at S8, if data of more than five bytes is received by the left buffer 41, the data of five bytes received by the left buffer 41 may be read and stored (S9).

Although the present invention has described and explained that the right buffer 42 is checked and the left buffer 42 is checked, the present invention is not limited thereto. That is, the above explanation is simply for convenience sake, and the left buffer 41 may be checked first and the right buffer 42 may be checked later, or both the left/right buffers 41, 42 may be simultaneously checked.

Furthermore, although the present invention has explained that the length of a start-notifying data is defined by one byte and the length of data of actual transmission is defined as 5 bytes, the present invention is not limited thereto, and it should be apparent to the skilled in the art that the length may be variably defined as necessary.

Then, data stored in the left/right buffers 41, 42 is combined (S10). That is, the one-byte data stored in S5 and 5-byte data stored in S7 and S9 may be combined. However, it should be apparent that the lengths of data corresponding to one byte and five bytes may be changed as necessary, as explained above.

The data currently stored in the left/right buffers 41, 42 corresponds to 6 bytes regardless of start byte, the 6-byte data are aligned and combined in accurate order from the above explained start byte. However, this explanation is exemplary and other methods of sequentially combining the bytes may be variable considered by receiving data of one frame. Thereafter, the combined messages may be transmitted to the on-board equipment (S11).

The apparatus and method for processing ATC intermittent information in railway according to the exemplary embodiment of the present invention has an advantageous industrial applicability in that frame loss can be minimized and processed accordingly, even if left/right messages of ATC intermittent information are received time-delayed or damaged by noise.

Meantime, although the apparatus and method for processing ATC intermittent information in railway have been described with reference to a number of limited illustrative embodiments thereof, it should be understood that numerous other modifications and embodiments can be devised by those skilled in the art that will fall within the spirit and scope of the principles of this disclosure.

More particularly, various variations and modifications are possible in the component parts and/or arrangements of subject combination arrangement within the scope of the invention, the drawings and the appended claims. In addition to variations and modifications in the component parts and/or arrangements, alternative uses will also be apparent to those skilled in the art.

What is claimed is:

1. A method for processing intermittent information in railway, the method comprising:

receiving, at a first buffer, first data from a first loop arranged in the railway;

receiving, at a second buffer, second data from a second loop arranged in the railway;

waiting, for a predetermined time, when length of any of the first data or the second data is longer than a first length;

continuing the receiving at the first buffer and the second buffer during the waiting for the predetermined time;

reading and storing at the first buffer and the second buffer, respectively, the first data and the second data, when both the first data and the second data are longer than the first length;

determining that third data and fourth data, each having a length longer than a second length, are respectively received at the first buffer and the second buffer;

reading and storing at the first buffer and the second buffer, respectively, the third data and the fourth data, when both the third data and the fourth data are longer than the second length; and generating, by a processor, final data by combining the first data, the second data, the third data and the fourth data.

2. The method of claim 1, further comprising:

clearing the first buffer when the first data is longer than the first length and the second data is not longer than the first length; and clearing the second buffer when the second data is longer than the first length and the first data is not longer than the first length.

3. The method of claim 1, wherein the first length corresponds to a length of a start-notifying data.

4. The method of claim 3, wherein the second length corresponds to a length of a data including information.

5. The method of claim 4, wherein the generating the final data includes aligning the start-notifying data at a forefront and aligning the data including the information after the start-notifying data.

6. The method of claim 1, further comprising:

transmitting the final data to on-board equipment in a train.

7. An apparatus for processing intermittent information in railway, the apparatus comprising:

a first antenna configured to receive intermittent information from a first loop arranged on the railway;

a second antenna configured to receive intermittent information from a second loop arranged on the railway;

a receiver configured to convert a message of an analog type signal received from the first antenna or the second antenna to a message of digital data, and a ATC (Automatic Train Control) on-board equipment configured to analyze the message of digital data, wherein the ATC on-board equipment includes:

a first buffer configured to store intermittent first data from the first loop;

a second buffer configured to store intermittent second data from the second loop; and a processor configured to generate a final data by combining the first data and the second data received from the first and second buffers, and wherein the processor is further configured to:

determine that the first data and the second data, each having a length longer than a first length, are respectively received at the first buffer and the second buffer;

read and store at the first buffer and the second buffer, respectively, the first data and the second data, when both the first data and the second data are longer than the first length;

determine that third data and fourth data, each having a length longer than a second length, are respectively received at the first buffer and the second buffer;

read and store at the first buffer and the second buffer, respectively, the third data and the fourth data, when both the third data and the fourth data are longer than the second length; and generate the final data by combining the first data, the second data, the third data and the fourth data.

8. The apparatus of claim 7, wherein the first and second buffers include a ring buffer.

9. The apparatus of claim 7, wherein the processor is further configured to wait, for a predetermined time, when length of any of the first data or the second data is longer than a first length.

10. The apparatus of claim 9, wherein the processor is further configured to clear the first buffer when the first data is longer than the first length and the second data is not longer than the first length; and clear the second buffer when the second data is longer than the first length and the first data is not longer than the first length.

11. The apparatus of claim 7, wherein the first length corresponds to a length of a start-notifying data.

12. The apparatus of claim 11, wherein the second length corresponds to a length of a data including information.

13. The apparatus of claim 12, wherein the processor is configured to align the start-notifying data at a forefront and align the data including the information after the start-notifying data.

14. The apparatus of claim 7, wherein the first antenna is configured to receive the first data transmitted from the first loop; and wherein the second antenna is configured to receive the second data transmitted from the second loop.

15. The apparatus of claim 14, further comprising:

a transmitter configured to convert the first data received from the first antenna and the second data received from the second antenna to a second digital signal, and transmit the second digital data to the first and second buffers.

* * * * *